US006232279B1

(12) United States Patent
Steigerwald

(10) Patent No.: US 6,232,279 B1
(45) Date of Patent: May 15, 2001

(54) FUEL-ECONOMY LUBRICATION-EFFECTIVE ENGINE OIL COMPOSITION

(75) Inventor: Edgar Andreas Steigerwald, Hamburg (DE)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/308,122

(22) PCT Filed: Nov. 12, 1997

(86) PCT No.: PCT/EP97/06301

§ 371 Date: Jun. 25, 1999

§ 102(e) Date: Jun. 25, 1999

(87) PCT Pub. No.: WO98/23711

PCT Pub. Date: Jun. 4, 1998

(30) Foreign Application Priority Data

Nov. 25, 1996 (GB) ..... 96244413

(51) Int. Cl.[7] ..... C10M 143/10; C10M 143/12
(52) U.S. Cl. ..... 508/591
(58) Field of Search ..... 508/591

(56) References Cited

U.S. PATENT DOCUMENTS 4,402,844 * 9/1983 Trepka .
5,616,542 * 4/1997 Sutherland .
5,641,731 * 6/1997 Baumgart et al. .
5,817,607 * 10/1998 Duncan et al. .

FOREIGN PATENT DOCUMENTS 0 081 852 * 6/1983 (EP) .
96/06904 * 3/1996 (WO) .
96/15211 * 5/1996 (WO) .

OTHER PUBLICATIONS

P.S. Coffin et al., The Application of Synthetic Fluids to Automotive Lubricant Development, Erdöl und Kohle–erdgas–Petrochemie, vol. 43, No. 5, pp. 190–195, May 1990.*

* cited by examiner

*Primary Examiner*—Jerry D. Johnson
(74) *Attorney, Agent, or Firm*—Joseph J. Allocca

(57) ABSTRACT

Lubricant compositions suitable for use in automotive engines, especially internal combustion engines, the lubricant having a kinematic viscosity at 100° C. of less than 12.5 $mm^2/s$ and a high temperature, high shear dynamic viscosity (i.e. at a temperature of 150° C. and a shear rate of $10^6/s$) of at least 2.9 mPa.s, and comprising (a) 70 to 99.5 wt. % of a base oil, preferably a mixture of poly-alpha-olefin and ester, having a kinematic viscosity at 100° C. of 2 to 8 $mm^2/s$ and a viscosity index of at least 120, and (b) 0.5 to 3 wt. % of an alkenylarene-conjugated diene copolymer, preferably styrene/butadiene copolymer, as a viscosity index improver. The lubricant provides an improvement in fuel economy performance whilst maintaining effective lubrication of the engine under operating conditions.

13 Claims, No Drawings

FUEL-ECONOMY LUBRICATION-EFFECTIVE ENGINE OIL COMPOSITION

This invention relates to a lubricant composition suitable for use in automotive engines, especially internal combustion engines.

The viscosity grade of an engine oil is a key feature when selecting a lubricant. The oil is chosen according to both the climatic temperatures to which the engine is exposed, and the temperatures and shear conditions under which the engine operates. Thus the oil must be of sufficiently low viscosity at ambient temperatures to provide adequate lubrication upon cold-starting of the engine, but must maintain sufficient viscosity to provide lubrication of the engine under full operating conditions where, for example, the temperature in the piston zone may reach 300° C. or more.

To meet both the high and low temperature viscosity requirements a multigrade engine oil is usually selected. Under the Society of Automotive Engineers classification system SAE (J 300) a passenger car multigrade engine oil is, for example, a 5W-40, 10W-40 or 15W-40 grade. The W grades are based on maximum low temperature dynamic viscosity under cold cranking conditions, as well as a minimum kinematic viscosity at 100° C. For example, a 5W grade has a maximum dynamic viscosity of 3500 mPa.s at −25° C. under a shear rate of $10^5$/s (Standard Cold Crankingr Simulator test ASTM D 2602), and a minimum kinematic viscosity at 100° C. of 3.8 $mm^2$/s (ASTM D 445). A 40 grade indicates a miniiuium kinematic viscosity of 12.5 $mm^2$/s at 100° C. and a maximum of less than 16.3 $mm^2$/s at 100° C. To achieve multi-grade viscosity properties, the engine oil formulations contain a viscosity index (VI) improver. These are polymeric materials such as polymethylacrylic acid esters, for example polymethyl-acrylate. Whilst VI improvers have the advantage that they reduce the temperature dependency of the oil's viscosity, they have the disadvantage that they cause the oil to become non-Newtonian in behaviour, i.e. the oil tends to suffer viscosity loss under high shearing stress. This is believed to be due to the breakup of inter-molecular bonds between the polymer chains of the VI improver, and also to the breaking of the polymer chains themselves, the type and extent of the breaking depending upon the nature of the specific VI improver employed and the severity of the shearing conditions. To ensure that an engine oil has sufficient viscosity under conditions of high shear and high temperature, such as those found in today's severe engine operating conditions, particularly in the region of the crankshaft bearings, some vehicle engine manufacturers have introduced a test which specifies a minimum dynamic viscosity of the oil under specified high temperature, high shear (HTHS) conditions (ASTM D 4741). Of the standard European engine tests devised by the Association des Constructeurs Européen d'Automobiles, the tests ACEA A2-96/A3-96 /B2-96/B3-96/E2-96 and E3-96 each require a minimum HTHS viscosity of 3.5 mPa.s at 150° C. and a shear rate of $10^6$/s; and tests ACEA A1-96 and B1-96 each require a minimum HTHS of 2.9 mPa./s at 150° C. and a shear rate of $10^6$/s.

In recent years there has been an increasing concern to improve the fuel economy performance of automotive engines, particularly passenger car engines. One factor influencing fuel economy is the viscosity of the engine oil—the lower the viscosity the lower the viscous drag on the engine and hence the better the fuel economy performance. Accordingly there is beginning to be a trend towards selecting lower grade multigrade oils such as 0W-30 or 5W-30 or even 0W-20 or 5W-20. 0W and 5W grades must have respectively maximum dynamic viscosities of 3250 mPa.s at −30° C. and 3500 mPa.s at −25° C., and a minimum kinematic viscosity at 100°C. of 3.8 $mm^2$/s. A 30 grade must have a minimum kinematic viscosity at 100° C. of 9.3 $mm^2$/s and a maximum of less than 12.5 $mm^2$/s; and a 20 grade must have a kinematic viscosity at 100° C. from 5.6 $mm^2$/s to less than 9.3 $mm^2$/s.

However, these lower viscosity grade oils must still meet the HTHS minimum dynamic viscosity requirements of the above-mentioned ACEA A classifications in order to provide adequate lubrication to the engine. This is the problem addressed by the present invention.

The present invention provides a lubricant composition having a kinematic viscosity at 100° C. (ASTM D 445) of less than 12.5 $mm^2$/s and a high temperature, high shear dynamic viscosity at a temperature of 150° C. and a shear rate of $10^6$/s (ASTM D 4741) of at least 2.9 mpa.s, which composition comprises, or is formulated from blending:

(a) from 70 to 99.5 wt. % base oil having a kinematic viscosity at 100° C. of from 2 to 8 $mm^2$/s and a viscosity index of at least 120; and (b) from 0.5 to 3 wt. % alkenylarene-conjugated diene copolymer as a viscosity index improver, the weight percents being based on the total weight of the composition.

Thus it has been found that by selecting a specific type of VI improver, mainly an alkenylarene-conjugated diene copolymer, and combining this with a relatively liow viscosity, high inherent VI base oil, then, for a given minimum HTHS viscosity which is sufficiently high to provide adequate lubrication of engine parts operating under conditions of high temperature and high shear, an engine oil can be formulated with lower high temperature kinematic viscosity than has previously been achievable, thereby providing fuel economy benefits.

In one specific embodiment, the invention provides a lubricant composition having a kinematic viscosity at 100° C. of less than 12.5 $mm^2$/s and a HTHS viscosity of at least 3.5 mPa.s at 150° C. and a shear rate of $10^6$/s, which composition comprises, or is formulated by blending:

(a) from 70 to 99.5 wt. % base oil having a kinematic viscosity at 100° C. of from 2 to 8 $mm^2$/s and a viscosity index of at least 120; and (b) from 1 to 3 wt. % alkenylarene-conjugated diene copolymer as a viscosity index improver, the weight percents being based on the total weight of the composition.

An engine oil according to this specific embodiment meets the SAE 30 grade. Preferably the base oil is selected so the engine oil meets the requirements of a 5W or a 0W grade as well, i.e. the engine oil is a 5W-30 or 0W-30 multigrade oil. The minimium HTHS viscosity of 3.5 mPa.s at 150° C. means that the lubricant meets the requirement of standard engine test specifications ACEA A2-96/A3-96/B2-96/B3-96/E2-96 and E3 -96. Preferably the engine oil according to this specific embodiment has a kinematic viscosity at 100° C. of no more than 11.5 $mm^2$/s, more preferably no more than 11.0 $mm^2$/s.

In another specific embodiment, the invention provides a lubricant composition having a kinematic viscosity at 100° C. of less than 9.3 $mm^2$/s and an HTHS viscosity of at least 2.9 mPa.s at 150° C. and a shear rate of $10^6$/s, which composition comprises, or is formulated by blending:

(a) from 70 to 99.5 wt. % base oil having a kinematic viscosity at 100° C. of from 2 to 8 $mm^2$/s and a viscosity index of at least 120; and (b) from 0.5 to 0.99 wt. % alkenylarene-conjugated diene copolymer as a viscosity index improver, the weight percents being based on the total weight of the composition.

An engine oil according to the second specific embodiment meets the SAE 20 grade. Preferably the base oil is selected so that the engine oil meets the requirements of a 5W or a 0 W grade as well, i.e. the engine oil is a 5W-20 or 0W-20 multigrade oil. The minimum HTHS viscosity of 2.9 mPa.s at 150° C. means that the lubricant meets the requirement of standard engine test specifications ACEA A1-96 and B1-96, whilst the even lower viscosity 20 grade provides enhanced fuel economy benefits.

In formulating the lubricant composition according to the invention any suitable base oil may be used provided it meets the requirements of having a kinematic viscosity at 100° C. of 2–8 mPa.s and a VI of at least 120, preferably from 120 to 160. In practice, this means the base oil is selected from one or more of synthetic oils, hydroisomerised petroleum-derived hydrocarbons, and hydrocracked petroleum-derived hydrocarbons, or a mixture or one or more of these base oils with a mineral, vegetable or animal oil, preferably mineral oil. It is preferred that the base oil is either one or more synthetic oils.

Examples of suitable synthetic oils include poly-alpha-olefins (PAO), such as those synthesised from alpha-olefin monomers containing from 6 to 20 carbon atoms, e.g. poly-1-decene; alkylbenzenes; polyglycols; alkylated diphenyl ethers; alkylated diphenyl sulphides; alkylene oxide polymers and their ester and ether derivatives; silicone-based oils such as siloxanes and silicates; and esters such as esters of monocarboxylic acids and polyols or polyol ethers, and esters of diacarboxylic acids with alcohols or suitable derivates thereof, e.g. butyl alcohol, ethylene glycol, trimethylol propane. Preferably the carboxylic acid (mono- or di-) contains from 4 to 20 carbon atoms, more preferably from 6 to 12 carbon atoms.

Where the base oil is a blend containing a proportion of mineral oil, the mineral oil is preferably selected to have a kinematic viscosity at 100° C. in the range from 2to 8 $mm^2/s$. Suitable mineral oils include petroleum-derived mineral oils which have been refined, for example, by acid refining, solvent refining, hydrotreating and the like. Generally the mineral oil component is a conventional mineral base oil, such as solvent neutral base oil, but may also be a more highly refined base oil, for example, a white oil, or maybe a mineral oil derived from alternative sources, for example, oils derived from coal tar or shale.

In a preferred embodiment the base oil is either PAO or an ester, or a blend of PAO and ester. Most preferably it is a blend of PAO and ester. In such a blend the weight ratio of PAO to ester is preferably in the range of from 1:10 to 20:1, more preferably from 1:1 to 10:1, and most preferably from 2:1 to 6:1.

In an alternative preferred embodiment the base oil is 100%, or substantially 100%, ester. It has been found that when the lubricant composition according to the invention is formulated with an ester as the sole base oil then further reductions in kinematic viscosity can be obtained for a given HTHS dynamic viscosity. Thus, for example, a lubricant may be formulated with a kinematic viscosity at 100° C. of 10.0 $mm^2/s$ or less together with an HTHS viscosity of at least 3.5 mPa.s at 150° C.

The total amount of base oil contained in the oil is preferably from 70 to 99.5 wt. %, more preferably from 75 to 95 wt. %, and most preferably from 80 to 90 wt. % based on the total weight of the lubricant composition. The remainder of the formulation is made up with the VI improver and, optionally, other additives which may be diluted with a diluent or solvent.

The amount of the alkenylarene-conjugated diene copolymer VI improver. contained in the lubricant composition is preferably from 0.3 to 3 wt. % based on the total weight of the composition, more preferably from 1 to 3 wt. %, and most preferably from 0.8 to 2.0 wt. %. This amount is based on active ingredient, that is the actual copolymer itself, and does not include any diluent or solvent that the copolymer may be mixed with prior to incorporation into the lubricant composition. Typically the copolymer is mixed with a diluent or solvent such that the amount of active ingredient is from 5 to 25 wt. %, more typically 10 to 20 wt. %, e.g. about 15 wt. % in the VI improver "package". When mixed with the diluent or solvent the amount of the resulting VI improver package incorporated into the lubricant composition is typically from 5 to 20 wt. %, more typically from 10 to 15 wt. %, based on the total weight of the lubricant composition. The diluent or solvent must be compatible both with the VI improver copolymer and the base oil. Preferably it is either a mineral or synthetic oil or a hydrocarbon solvent, more preferably it is the same as the base oil or one of the base oil components. In an especially preferred embodiment, the VI improver is mixed with an ester.

The alkenylarene-conjugated diene copolymer is preferably a monovinylarene-hydrogenated conjugated diene random block copolymer. The preferred characteristics are: number average molecular weight ($M_n$)94 000–199 000; 44–70 wt. % of conjugated diene; 30–56 wt. % of total monovinylarene of which about 9–23 wt. % is terminal block monovinylarene; 30–51 wt. % of vinyl, prior to hydrogenation, based on diene (normalised); 13–33 wt. % vinyl, prior to hydrogenation, based on the entire copolymer; and 60–72 wt. % vinyl, based on entire copolymer plus monovinylarene. The copolymer is a random block copolymer meaning that it is formed of blocks of monovinylarene homopolymer and blocks of copolymerised (poly monovinylarene-conjugated diene). A preferred copolymer is styrene-butadiene copolymer, that is a copolymer formed by copolymerising styrene and butadiene to form a styrene-butadiene/styrene (SBS) block copolymer. Further details of such copolymers and their methods of manufacture are given in EP-A-081852, the disclosure of which is incorporated herein by reference. An example of a suitable SBS copolymer VI improver is Glissoviscal PG (trade name) supplied by BASF.

In a preferred embodiment the lubricant composition according to the invention also contains a friction modifier, particularly a molybdenum-containing compound. The addition of a friction modifier provides further benefits in fuel economy at boundary lubricating conditions, and molybdenum compounds have been found to be advantageous. Suitable molybdenum compounds are those which are soluble or dispersible in the lubricant base oil, and are usually organo-molybdenum compounds.

The organo group of the organo-molybdenum compound is preferably selected from a carbamate, phosphate, carboxylate and xanthate groups and mixtures thereof, which groups may be substituted with a hydrocarbyl group and/or one or more heteri) atoms, with the proviso that the organo group selected results in an organo-molybdenum compound that is oil-soluble or oil-dispersible, preferably oil-soluble.

Where the organo group is a carbamate, which is preferred, the organo-molybdenum compound is preferably a molybdenum dicarbamate, more preferably an oxysulphurised molybdenum dithiocarbamate of the formula:

(I)

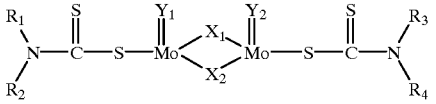

where $R_1$, $R_2$, $R_3$ and $R_4$ each independently represent a hydrogen atom, a $C_1$ to $C_{20}$ alkyl group, a $C_6$ to $C_{20}$ cycloalkyl, aryl, alkylaryl or arylalkyl group, or a $C_3$ to $C_{20}$ hydrocarbyl group containing an ester, ether, alcohol or carboxyl group; and $X_1$, $X_2$, $Y_1$ and $Y_2$ each independently represent a sulphur or oxygen atom.

Examples of suitable groups for each of $R_1$, $R_2$, $R_3$ and $R_4$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. Preferably $R_1$ to $R_4$ are each $C_6$ to $C_{18}$ alkyl groups, more preferably $C_{10}$ to $C_{14}$.

It is preferred that $X_1$ and $X_2$ are the same, and $Y_1$ and $Y_2$ are the same. Most preferably $X_1$ and $X_2$ are both sulphur atoms, and $Y_1$ and $Y_2$ are both oxygen atoms.

Thus in a preferred embodiment the organo-molybdenum compound is oxysulphurised oxymolybdenum dithiocarbamate wherein the thiocarbamate groups contain $C_{10}$ to $C_{14}$ alkyl groups An example is Molyvan 822 (trade name) available from R.T. Vanderbilt Company.

Where the organo group is a phosphate, it is preferably a dithiophosphate group. An example of a molybdenum dithiophosphate compound is Molyvan L (trade name) available from R.T. Vanderbilt Company.

Where the organo group is a carboxylate, this is preferably a $C_1$ to $C_{50}$, more preferably a $C_6$ to $C_{18}$, carboxylate group. Examples of suitable carboxylates include octoate, e.g. 2-ethyl hexanoate, naphthenate and stearate. The molybdenum compounds may be prepared, for example, by reacting molybdenum trioxide with the alkali metal salt of the appropriate carboxylic acid under suitable conditions. Examples include Molynapall (trade name), a molybdenum naphthenate, and Molyhexchem (trade name) a molybdenum Z-ethyl hexanoate, both available from Mooney Chemicals.

Where the organo group of the organo-molybdenum compound is a xanthate, the compound preferably has the formula:

$$Mo_2\,(ROCS_2)_4 \qquad \text{(II)}$$

where R is a $C_1$ to $C_{30}$ hydrocarbyl group, preferably an alkyl group. Examples of suitable molybdenum xanthate compounds and their method of preparation are described in European patent application EP-A-433025, the disclosure of which is incorporated herein by reference.

An alternative molybdenum compound that may be employed as a friction modifier is a molybdenum complex obtained by reacting a molybdenum source with a glycerol ester of fatty acids containing at least 12 carbon atoms and diethanolamine. Such compounds and their method of manufacture is described in EP-A-222143, the disclosure of which is incorporated herein by reference. An example is Molyvan 855 available from R.T. Vanderbilt Company.

The amount of friction modifier, preferably a molybdenum-containing compound, contained in the lubricant composition, based on active ingredient, is preferably from 0.05 to 3.0 wt. %, more preferably, from 0.1 to 1.5 wt. % of the total weight of the lubricant composition. Where the friction modifier is a molybdenum-containing compound the amount by weight of molybdenum in the finished lubricant is preferably from 50 to 3000 ppm, more preferably from 100 to 1500 ppm.

The lubricant composition may also contain other, conventional lubricant additives, including, for example, detergents, dispersants, antioxidants, antiwear agents, extreme pressure agents, corrosion inhibitors, antifoaming agents, and pour point depressants. Generally these are provided in the form of active ingredient dissolved in a diluent. The amount of diluent is typically in the range of 10 to 25 wt. % based on the total additive supplied. The diluent is usually a hydrocarbon, for example a mineral or synthetic oil.

The lubricant composition according to the invention may be used in any application where lubrication is needed, provided it meets the requirements of that application. However, it is especially suitable for internal combustion engines, including both gasoline and diesel-fuelled engines.

The invention will now be illustrated by the following Examples.

EXAMPLES

A number of engine oils were formulated as shown in Table 1 below using conventional lubricant blending techniques:

TABLE 1

| Component | Purpose | Wt. % Example 1 | Example 2 | Example 3 |
|---|---|---|---|---|
| PAO 4[1] | Synthetic base oil | 68.2 | 28.7 | 39.3 |
| PAO 6[2] | Synthetic base oil | — | 40.0 | 30.0 |
| Priolube 3970[3] | Synthetic base oil | 15.0 | 15.0 | 14.8 |
| Glissoviscal PG[4] | VI Improver | 1.7 | 1.7 | 0.9 |
| Molyvan 822[5] | Friction modifier | 0.6 | 0.6 | 0.5 |
| Addpack[6] | Conventional engine oil additive package | 14.5 | 14.4 | 14.5 |
| Kinematic viscosity at 100° C. of total base oil component ($mm^2/s$) | | 3.86 | 4.76 | 4.46 |
| Kinematic viscosity at 40° C. of total base oil component ($mm^2/s$) | | 16.7 | 22.2 | 20.6 |
| Viscosity index of total base oil component | | 125 | 139 | 131 |

Notes

[1]Poly-alpha-olefin having kinematic viscosity at 100° C. of 3.9 $mm^2/s$ and a viscosity index of 126.

[2]Poly-alpha-olefin having kinematic viscosity at 100° C. of 5.7 $mm^2/s$ and a viscosity index of 138.

[3]A $C_8$–$C_{10}$ fatty acid ester of trimethylol, propane available from Unichema.

[4]A styrene-butadiene/styrene random block copolymer available from BASF. To facilitate blending the Glissoviscal PG polymer is mixed with some of the Priolube 3970 ester (treat level 5 wt. % polymer). The weight percents given in Table 1 take this into account - the wt. % Glissoviscal PG is the amount of actual polymer, and the wt. % Priolube 3970 base oil has been increased to allow for the amount of diluent.

[5]An oxysulphurised molybdenum dithiocarbamate contained in diluent (40 wt. % active ingredient) available from R. T. Vanderbilt Company. For Examples 1 and 2 the amount of elemental molybdenum contained in the formulation is 300 ppm; for Example 3, 250 ppm.

[6]A mixture of conventional dispersant, detergent, antioxidant and antiwear agent contained in diluent. The same addpack was used in all the Examples.

The engine oil formulations were then tested as follows: The kinematic viscosity at 100° C. ($KV_{100}$) (ASTM D 445) and the Cold Cranking Simulator (CCS) low temperature apparent viscosity at −30° C. (ASTM D 5293) were measured to determine the SAE (J300) grade of the oil. The dynamic viscosity at 150° C. and a shear rate of $10^6$/s (ASTM D 4741) was measured to determine the high temperature, high shear (HTHS) viscosity of the oil. The fuel economy performance was determined by testing the oil in a standard API Sequence VI laboratory engine test. The result is given as a percentage which is the increased fuel economy obtained relative to a standard reference oil. A benefit of greater than 1.5% merits the API classification 'Energy Conserving', and greater than 2.7% merits 'Energy Conserving II'.

The results are given in Table 2 below.

TABLE 2

| | Example 1 | Example 2 | Example 3 |
|---|---|---|---|
| SAE grade | 0W-30 | 5W-30 | 0W-20 |
| $KV_{100}$ ($mm^2$/s) | 11.02 | 10.99 | 9.03 |
| CCS @ −25° C. (mPa.s) | — | 2000 | — |
| CCS @ −30° C. (mPa.s) | 2370 | 3350 | |
| HTHS (mPa.s) | 3.50 | 3.52 | 2.92 |
| Fuel economy (%) | 2.92 | Not tested | Not tested |

These results demonstrate that, by using the composition according to the invention, engine oils can be formulated with lower high temperature kinematic viscosities, thereby achieving fuel economy benefits, together with sufficient HTHS viscosities to ensure effective lubrication of the engine during operation.

What is claimed is:

1. A lubricant composition having a kinematic viscosity at 100° C. (ASTM D 445) of less than 12.5 $mm^2$/s and a high temperature, high shear dynamic viscosity at a temperature of 150° C. and a shear rate of $10^6$/s (ASTM D 4741) of at least 2.9 mPa.s, which composition comprises, or is formulated from blending:

(a) from 70 to 99.5 wt. % base oil having a kinematic viscosity at 100° C. of from 2 to 8 $mm^2$/s and a viscosity index of at least 120; and (b) from 0.5 to 3 wt. % alkenylarene-conjugated diene block copolymer as a viscosity index improver, said block copolymer formed of blocks consisting of alkenylarene homopolymer and blocks consisting of alkenylarene-conjugated diene copolymer, the weight percents being based on the total weight of the composition.

2. The composition of claim 1 having a high temperature, high shear dynamic viscosity at 150° C. and a shear rate of $10^6$/s (ASTM D 4741) of at least 3.5 mPa.s.

3. A lubricant composition according to claim 2 which has a kinematic viscosity at 100° C. of no more than 11.5 $mm^2$/s.

4. A lubricant composition having a kinematic viscosity at 100° C. (ASTM D 445) of less than 9.3 $mm^2$/s and a high temperature, high shear dynamic viscosity at a temperature of 150° C. and a shear rate of $10^6$/s (ASTM D 4741) of at least 2.9 mPa.s, which composition comprises, or is formulated from blending:

(a) from 70 to 99.5 wt. % base oil having a kinematic viscosity at 100° C., of from 2 to 8 $mm^2$/s and a viscosity index of at least 120; and (b) from 0.5 to 0.99 wt. % alkenylarene-conjugated diene block copolymer as a viscosity index improver, said block copolymer formed of blocks consisting of alkenylarene homopolymer and blocks consisting of alkenylarene-conjugated diene copolymer, the weight percents being based on the total weight of the composition.

5. The lubricant composition of claim 1 or 4 wherein the alkenylarene is a monovinylarene.

6. The lubricant composition of claim 5 wherein the block copolymer comprises 44 to 70 wt % conjugated diene and 30 to 56 wt % monovinylarene.

7. The lubricant composition of claim 6 wherein the base oil is a synthetic oil.

8. A lubricant composition according to claim 7 wherein the base oil is selected from one or more of poly-alpha-olefin and ester base oils.

9. A lubricant composition according to claim 8 wherein the base oil is a poly-alpha-olefin or a mixture of poly-alpha-olefins.

10. A lubricant composition according to claim 8 wherein the base oil is an ester or a mixture of esters.

11. A lubricant composition according to claim 8 wherein the base oil is a mixture of poly-alpha-olefin and ester, the weight ratio of poly-alpha-olefin to ester being from 3:1 to 6:1.

12. A lubricant composition according to claim 11 wherein the monovinylarene is styrene and the conjugated diene is butadiene.

13. In the operation of an internal combustion engine wherein the engine is lubricated with an engine oil, the improvement comprising using as the engine oil a lubricating composition having a kinematic viscosity at 100° C. (ASTM D 445) of less than 12.5 $mm^2$/s and a high temperature, high shear dynamic viscosity at a temperature of 150° C. and a shear rate of $10^6$/s (ASTM D 4741) of at least 2.9 mPa.s., which composition comprises:

(a) from 70 to 99.5 wt % base oil having a kinematic viscosity at 100° C. of from 2 to 8 $mm^2$/s; and (b) from 0.5 to 3 wt. % of an alkenylarene conjugated diene block copolymer as a viscosity index improver, said block copolymer formed of blocks consisting of alkylarene homopolymer and blocks of alkenylarene-conjugated diene copolymer, the weight percents being based on the total weight of the composition.

* * * * *